US005954941A

United States Patent [19]

Mercier et al.

[11] Patent Number: 5,954,941

[45] **Date of Patent: *Sep. 21, 1999**

[54] JET ENGINE FUEL AND PROCESS FOR MAKING SAME

[75] Inventors: Sophie Mercier, Rouen; Michel Laborde, Le Havre; François-Xavier Cormerais, Le Havre; Michel Thebault, Le Havre, all of France

[73] Assignee: Total Raffinage Distribution S.A., Puteaux, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/776,170

[22] PCT Filed: May 22, 1996

[86] PCT No.: PCT/FR96/00762

§ 371 Date: Apr. 28, 1997

§ 102(e) Date: Apr. 28, 1997

[87] PCT Pub. No.: WO96/37577

PCT Pub. Date: Nov. 28, 1996

[30] Foreign Application Priority Data

May 22, 1995 [FR] France ..... 95 06049

[51] Int. Cl.[6] ..... C10L 1/00; C10G 45/00

[52] U.S. Cl. ..... 208/15; 208/65; 208/89; 208/144; 208/145; 208/212; 208/264; 585/269; 585/273; 585/277

[58] Field of Search ..... 208/15, 16, 69, 208/65, 143, 144, 145, 89, 212, 264; 585/14, 13, 266, 269, 270, 274, 275, 276, 277, 273

[56] References Cited

U.S. PATENT DOCUMENTS

| | | | |
|---|---|---|---|
| 3,175,970 | 3/1965 | Bercik et al. | 208/212 |
| 3,607,729 | 9/1971 | Robinson et al. | 208/112 |
| 3,985,638 | 10/1976 | Kirk, Jr. | 208/15 |
| 4,019,976 | 4/1977 | Cosyns et al. | 208/57 |
| 4,332,666 | 6/1982 | Bauman et al. | 208/8 LE |
| 4,409,092 | 10/1983 | Johnson et al. | 208/89 |
| 4,645,585 | 2/1987 | White | 208/58 |

OTHER PUBLICATIONS

Reddy, K.M., Song, C., abstract, "Mesoporous zeolite–supported noble metal catalysts for low–temperature hydrogenation of aromatics in distillate fuels", ACS 212th National Meeting, ACS division of Fuel Chemistry reprints, V41, N.3, 906–910 (1996), Aug. 1996.

Storemont, D.H., "SST's to spur big jet fuel surge", Oil & Gas Journal, V.69, pp. 39–42, May 1967.

*Primary Examiner*—Bekir L. Yildirim

*Attorney, Agent, or Firm*—Frommer Lawrence & Haug LLP; A. Thomas S. Safford; Thomas J. Kowalski

[57] ABSTRACT

The invention concerns a jet engine fuel having the following characteristics:

i) distilling range from 140 to 300° C.;

ii) cis-decalin/trans-decalin ratio greater than 0.2;

iii) aromatics content less than 22% by volume;

iv) sulfur content less than 100 ppm, and v) lower heating value per unit volume greater than 34.65 Mj/liter.

Also process for making the same wherein for example a cut from catalytic cracking distilling between 140 and 300°0 C. is subjected to a hydrotreatment step and then to a dearomatization step.

18 Claims, 1 Drawing Sheet

JET ENGINE FUEL AND PROCESS FOR MAKING SAME

FIELD OF THE INVENTION

The present invention relates to jet engine fuels, or fuels for jet engines, and to a process for making same.

BACKGROUND OF THE INVENTION

Numerous processes have been proposed for making fuels for jet engines from a wide range of raw materials.

In general, fuel for jet engines or jet engine fuel is produced from a kerosene fraction obtained by straight atmospheric distillation of crude petroleum and distilling between 140 and 300° C. and more typically between 150 and 270° C. This fraction is then treated in a desulfurization unit or in a unit for converting mercaptans into disulfides.

Another manufacturing process consists of hydrocracking a fraction of vacuum distillate. Fractionation of the effluents then affords a jet engine fuel requiring no further treatments. The jet engine fuel thus obtained, however, has very low lubricating power, i.e., insufficient for said fuel to be used in jet engines in its pure state. For this reason, said fuel must be blended with other jet engine fuels, particularly those obtained by straight distillation, which have better lubricating power and thus compensate for this deficiency.

Jet engine fuels are meant to feed the burners of aircraft turbojet and jet engines. To this end, the jet engine fuels must have certain properties. In particular, jet engine fuel Jet A1, which is the jet engine fuel most commonly used in commercial aviation, definitely must have a sulfur content of less than 0.30 wt %, a content of aromatic compounds of less than 22% by volume, a flash point above 38° C., a smoke point above 25 mm and a decongealing point below −47° C. According to the prior art manufacturing processes, jet engine fuels have similar energy qualities and a lower heating value per unit volume, namely less than 34.60 Mj/liter. Other properties of jet engine fuel Jet A1 are presented in Table 6 following this description and the examples illustrating the practice of the invention. In said Table 6 are also collected the properties of the jet engine fuels made according to these examples.

Requirements placed on jet engine fuels are becoming more stringent, and means for producing jet engine fuel within a conventional refinery are limited. Hydrocracking units are extremely costly, and the quantities of jet engine fuels made by atmospheric distillation of crude petroleum are limited and depend on the quality of the crudes.

Moreover, refineries whose mode of conversion is based on catalytic cracking have at their disposal only jet engine fuels produced by straight distillation.

In fact, the effluents from a catalytic cracking unit contain very high amounts of aromatics, olefins and sulfur compounds.

Because dearomatization catalysts are based on platinum and are very sensitive to sulfur, sulfur compounds must be removed by previous hydrotreatment.

Such hydrotreatment is exothermic, however, and is therefore difficult to carry out.

OBJECTIVES AND DESCRIPTION OF THE INVENTION

In trying to resolve this problem encountered in the prior art, applicants have discovered that it is possible to produce jet engine fuels from a cut resulting from catalytic cracking.

Surprisingly, applicants have also discovered that the jet engine fuel produced by catalytic cracking (namely by high-temperature cracking in the presence of a catalyst and without hydrogen) followed by hydrotreatment is different from that obtained by cracking in the presence of hydrogen (hydrocracking) and is of higher quality than the latter.

Thus, applicants have developed a jet engine fuel characterized in that it has i) a distilling range from 140 to 300° C.;

ii) a cis-decalin/trans-decalin ratio greater than 0.2;

iii) an aromatics content of less than 22% by volume;

iv) a sulfur content of less than 100 ppm, and v) a lower heating value per unit volume greater than 34.65 Mj/liter.

Preferably, the jet engine fuel according to the invention has a lower heating value per unit volume from 34.65 to 35.30 Mj/liter.

The jet engine fuel according to the invention thus differs from the prior art jet engine fuels particularly in that it has a higher heating value leading to lower volume consumption compared to prior-art jet engine fuels.

The invention also has as an object to provide a novel process for making jet engine fuel of improved properties. This process is new and original in that it does not utilize conventional routes of jet engine fuel production. Hence, it allows additional production of jet engine fuel in a refinery, over and above the quantity produced from a cut obtained by atmospheric distillation of crude petroleum.

This process makes it possible to obtain a jet engine fuel from a cut resulting from the fractionation of the effluent from a catalytic cracking unit. A cut from a catalytic cracking unit distilling between 140 and 300° C. can thus be upgraded.

Nevertheless, said cut from a catalytic cracking unit generally requires a certain number of specific treatments before it becomes a jet engine fuel with properties required for its acceptance.

Different treatments to convert the cut from catalytic cracking into a jet engine fuel can be envisaged. According to the invention, however, the cut from catalytic cracking is preferably treated in two steps: a hydrotreatment step and a dearomatization step.

Usually, said cut from catalytic cracking has an olefin content from 20 to 45% and an aromatics content from 40 to 70%, based on total volume.

Jet engine fuel specifications, however, limit this aromatics content to a maximum of 22% which makes dearomatization necessary. Moreover, because the dearomatization catalyst is quite sensitive to impurities, hydrotreatment before dearomatization is necessary.

The purpose of the hydrotreatment step is to remove sulfur and nitrogen from, and to hydrogenate the olefins present in, the cut from a catalytic cracking unit. If nitrogen removal from the feedstock during hydrotreatment is only minor or insufficient, a complementary nitrogen removal step must be incorporated into the process design.

The cut from catalytic cracking has very different properties from those required to produce the prior-art jet engine fuels.

Thus said cut contains more olefins than the cut obtained by direct atmospheric distillation and, moreover, it differs from the cut from the hydrocracking feedstock which is a vacuum distillate with a higher boiling point.

This explains why the properties of the jet engine fuel of the present invention differ from those of jet engine fuels obtained by the usual routes.

The jet engine fuel according to the invention thus presents improved combustion properties in jet propulsion motors. In fact, it has a higher concentration of polycyclic naphthenes relative to the total concentration of naphthenes in the jet engine fuel which results in a substantial gain in energy per unit volume, namely greater than 0.5%. Hence, under identical conditions, the volume consumption of the jet engine fuel of the invention will be less than that of a jet engine fuel of the prior art.

The jet engine fuel according to the invention generally has a cis-decalin/trans-decalin ratio greater than 0.2 and preferably greater than 0.3.

The reason for this is that the cut from catalytic cracking from which the jet engine fuel is obtained is rich in olefins, particularly dicycloolefins, which are cis-decalin precursors.

The jet engine fuel according to the invention also preferably has a naphthalene/trans-decalin ratio lower than 0.05. In fact, the hydrogenation step according to the process of the invention converts the great majority of naphthalenes present into decalins.

The jet engine fuel of the invention preferably has a naphthene/paraffin ratio from 1.2 to 2.

Moreover, the jet engine fuel according to the invention has very good low-temperature properties, better than those required for the Jet A1 jet engine fuel. For this reason, the jet engine fuel according to the invention can be used advantageously under conditions of severe cold and particularly in the field of military aviation.

Moreover, the jet engine fuel according to the invention can be blended with other jet engine fuel bases which makes it possible, if necessary, to improve the properties of the jet engine fuels, particularly their energy qualities, while meeting the specifications prescribed for a Jet A1 jet engine fuel.

The process for making the jet engine fuel according to the invention will now be explained in detail.

The hydrotreatment of the cut from catalytic cracking is carried out in the presence of a catalyst disposed in a reactor in the form of one or more fixed beds. The catalyst consists of at least one hydrogenating and/or hydrogenolyzing metal deposited on a virtually neutral support, for example a catalyst based on nickel and molybdenum, such as the TK 525 catalyst made by Haldor Topsoe company or the HR 348 catalyst made by the Procatalyse company.

Other types of catalysts can also be used, particularly catalysts based on cobalt and molybdenum such as HR 306 and HR 316 made by Procatalyse, KF 752 made by Akzo and TK 524 and TK 554 made by Haldor Topsoe. The reaction temperature is generally between 250 and 350° C. at a minimum pressure of $30\times10^5$ pascal (30 bar) and a liquid hourly space velocity of about 1 to 5 $h^{-1}$, the hydrogen/hydrocarbon volume ratio at the inlet to the reactor being from 100 to 500 $Nm^3/m^3$ and preferably from 200 to 300 $Nm^3/m^3$. Advantageously, the temperature is about 280° C. at a pressure of $35\times10^5$ pascal.

The hydrotreatment step gives rise to strongly exothermic reactions. To control this phenomenon, those skilled in the art will adjust various factors, particularly the reactor inlet temperature, the hydrogen/hydrocarbon ratio and the quantity of olefins in the feedstock. A diluent such as reactor recycle material or, preferably, kerosene obtained by atmospheric distillation of crude petroleum can optionally be blended with the feedstock to reduce its olefin concentration.

In the case of a reactor wherein the catalyst is disposed in several fixed beds, a tempering fluid can be injected between said beds, the nature, flow rate and temperature of said fluid being selected so as to control the exothermicity of the reactions occurring in this hydrotreatment step. The tempering fluid can consist of material recycled to the unit, hydrogen or preferably kerosene obtained by atmospheric distillation.

The partial dearomatization reaction of the effluent from the desulfurization unit is carried out in the presence of a catalyst disposed in the reactor in the form of, for example, one or more fixed beds. The selection of the catalyst to be used depends on reactor operating conditions.

The catalyst can be a sulfur-resistant material consisting of at least one hydrogenating noble metal deposited on an acidic support, said noble metal being, in particular, platinum or palladium. For example, sulfur-resistant catalysts such as LD 402 made by Procatalyse, AS-100 made by Criterion and TK 908 made by Haldor Topsoe can be used for this purpose.

The catalyst used can also be nickel-based, which turns out to be a route of interest, because it is more economical than that employing catalysts containing platinum or palladium. For example, catalysts such as HTC 400 and HTC 500 made by Crosfield and C46-7-03 and L3427 made by Sued-Chemie can be used. Crosfield's HTC 400 catalyst is preferred.

In the case of catalysts containing a noble metal, the reaction temperature is generally between 200 and 300° C. at a minimum pressure of $30\times10^5$ Pa, the liquid hourly space velocity is from 1 to 5 $h^{-1}$ and the hydrogen/hydrocarbon volume ratio at the reactor inlet is from 500 to 900 $Nm^3/m^3$ and preferably 600 $Nm^3/m^3$ ($Nm^3$ here means Normal cubic meter; one normal $m^3$ corresponds to one $m^3$ of gas under standard conditions of temperature and pressure, namely 0° C. and 1 atmosphere or $1.01325\times10^5$ Pa.). Advantageously, the temperature is about 240° C. at a pressure of about $50\times10^5$ Pa.

In the case of a nickel-based catalyst, the reaction temperature is generally from 100 to 200° C. at a minimum pressure of $30\times10^5$ Pa, the liquid hourly space velocity is from 1 to 5 $h^{-1}$, and the hydrogen/hydrocarbon volume ratio at the reactor inlet is from 600 to 1000 $Nm^3/m^3$. Advantageously, the temperature is about 160° C. at a pressure of about $50\times10^5$.

Preferably, the catalyst for the dearomatization step is disposed in several beds between which is injected a tempering fluid to control the exothermicity of the dearomatization reaction.

Depending on the type of catalyst used in the two steps described hereinabove, a complementary nitrogen removal step can be carried out prior to dearomatization. In fact, certain dearomatization catalysts are sensitive to nitrogen which causes their inactivation. For this reason, if the selected hydrotreatment catalyst has not sufficiently reduced the nitrogen content of the feedstock, said feedstock must be treated so as to reduce the nitrogen content to a very low value of about 10 ppm. Such treatment can be carried out by different means, for example, by use of a conventional nitrogen trap containing a nitrogen scavenger.

Depending on the type of catalyst used in the dearomatization step, the effluent from the hydrotreatment step must be washed to eliminate the dissolved ammonia and hydrogen sulfide which constitute limiting factors or poisons for certain types of dearomatization catalysts.

The following examples illustrate different methods of preparation of prior-art jet engine fuels and of jet engine fuels according to the invention. They are not limiting in nature and are meant to illustrate the advantages of the jet engine fuels of the invention.

BRIEF DESCRIPTION OF THE DRAWINGS

In this specification and in the accompanying drawing, some preferred embodiments of the invention are shown and described and various alternatives and modifications thereof have been suggested; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

EXAMPLES

Example 1

Figure 1:
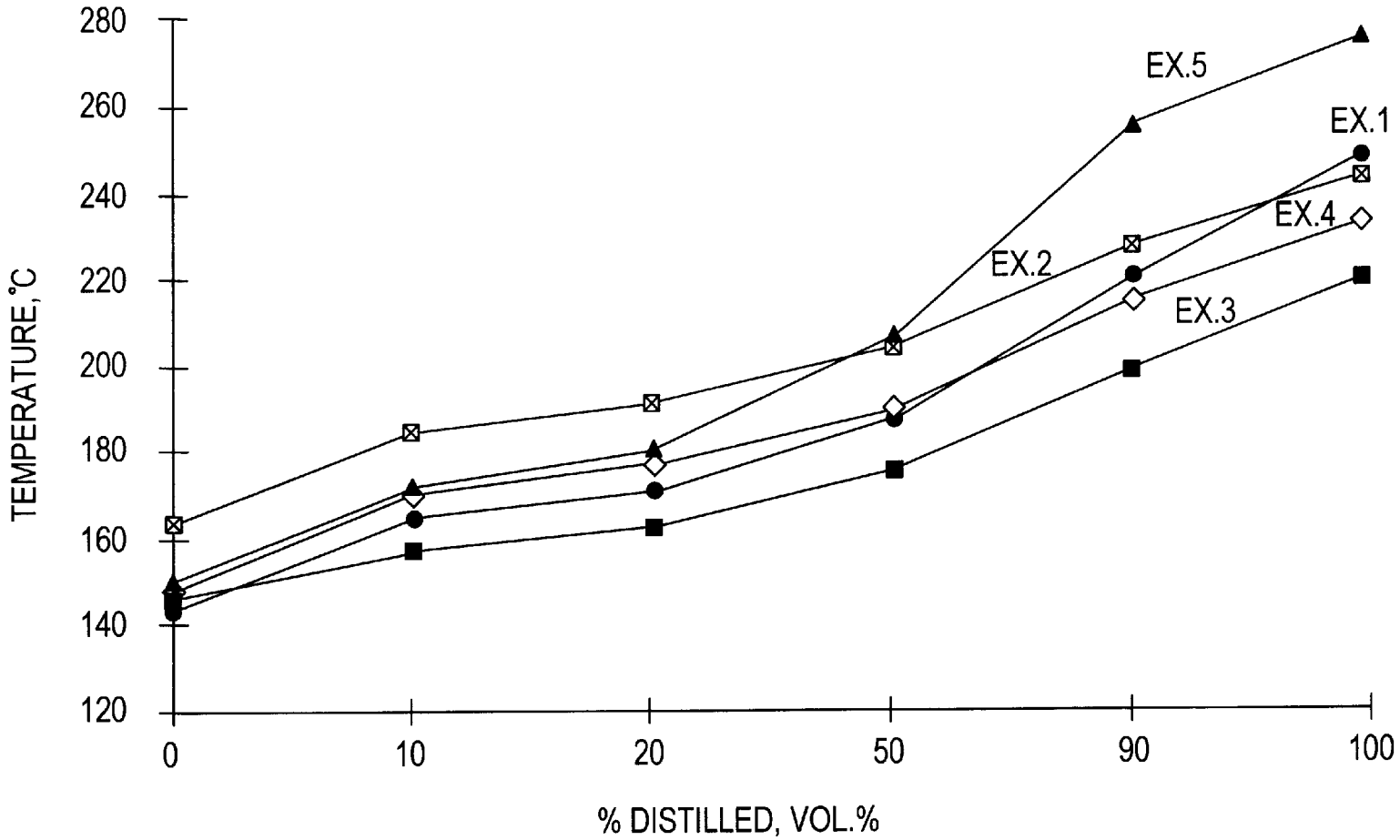
FIG. 1 is a graph containing the various distillation curves representative of the jet engine fuels described in the examples.

A feedstock distilling between 150 and 250° C., stemming directly from fractionation carried out in a catalytic cracking unit, was treated in accordance with the process of the invention.

The feedstock was first treated in a hydrotreatment unit. The catalyst used was based on alumina with a specific surface of 220 $m^2/g$ and a pore volume of 0.5 $cm^3/g$ and containing 4.2 wt % of nickel oxide and 16.5 wt % of molybdenum. The average temperature used was 325° C. at about $35\times10^5$ Pa, the liquid hourly space velocity was 3 $h^{-1}$ and the hydrogen/hydrocarbon ratio was 200 $Nm^3/m^3$.

A Haldor Topsoe TK 908 catalyst was used for the dearomatization. The average temperature was 240° C. at about $50\times10^5$ Pa, the liquid hourly space velocity was 1 $h^{-1}$ and the hydrogen/hydrocarbon ratio was 600 $Nm^3/m^3$.

The properties of the feedstock, of the effluent after hydrotreatment and of the jet engine fuel obtained after dearomatization are collected in the following Table 1.

TABLE 1

| | Feedstock | Effluent from Hydrotreatment | Jet Engine Fuel |
|---|---|---|---|
| Sp. gravity at 15° C. | 0.841 | 0.827 | 0.803 |
| Sulfur, ppm | 3000 | 19 | 0 |
| Nitrogen, ppm | 100 | 5 | 0 |
| Aromatic compounds, vol. % | 45.4 | 44 | 7.2 |
| Olefins, vol. % | 40.3 | 0 | 0 |
| Naphthenes/paraffins | — | 0.54 | 1.54 |
| cis-Decalin/trans-decalin | — | — | 0.55 |
| Naphthalene/trans-decalin | — | — | 0 |

The distillation curve is shown in the single drawing attached herewith.

Example 2

A blend consisting of 50 wt % of a kerosene fraction boiling from 140 to 270° C. and obtained by straight distillation of crude petroleum and 50 wt % of a feedstock boiling from 160 to 240° C. and stemming directly from fractionation carried out in a catalytic cracking unit was treated in accordance with the process of the invention.

The feedstock was first treated in a hydrotreatment unit. The catalyst was the same as in Example 1. The average temperature was 300° C. at about $35\times10^5$ Pa, the liquid hourly space velocity was 4 $h^{-1}$ and the hydrogen/hydrocarbon ratio was 200 $Nm^3/m^3$.

Haldor Topsoe TK 908 catalyst was used for the dearomatization step. The average temperature was 270° C. at about $50\times10^5$ Pa, the liquid hourly space velocity was 3 $h^{-1}$ and the hydrogen/hydrocarbon ratio was 600 $Nm^3/m^3$.

The properties of the feedstock, of the effluent after hydrotreatment and of the jet engine fuel after dearomatization are collected in the following Table 2.

TABLE 2

| | Blend | Effluent from Hydrotreatment | Jet Engine Fuel |
|---|---|---|---|
| Sp. gravity at 15° C. | 0.832 | 0.823 | 0.813 |
| Sulfur, ppm | 4565 | 62 | 0.1 |
| Nitrogen, ppm | 91 | 5 | 0 |
| Aromatic compounds, vol. % | 38 | 36.1 | 21 |
| Olefins, vol. % | 13.9 | 0 | 0 |
| Naphthenes/paraffins | — | 0.35 | 0.68 |
| cis-Decalin/trans-decalin | — | — | 0.48 |
| Naphthalene/trans-decalin | — | — | 0 |

The distillation curve is shown in the single drawing attached herewith.

This example illustrates the use, as diluent, of a fraction of kerosene obtained by straight distillation of crude petroleum, which made it possible to control the exothermicity of the hydrotreatment reactions and at the same time to improve the basic properties of said kerosene fraction (particularly its decongealing point and its lower heating value).

Example 3

A feedstock distilling between 150 and 270° C., stemming directly from fractionation carried out in a catalytic cracking unit, was treated in accordance with the process of the invention.

The feedstock was first treated in a hydrotreatment unit. The catalyst used was based on alumina with a specific surface of 210 $m^2/g$ and a pore volume of 0.6 $cm^3/g$ and containing 2.8 wt % of cobalt oxide and 13.8 wt % of molybdenum. The average temperature was 325° C. at about $35\times10^5$ Pa, the liquid hourly space velocity was 3 $h^{-1}$ and the hydrogen/hydrocarbon ratio was 300 $Nm^3/m^3$.

A Crosfield HTC 400 catalyst was used for the dearomatization step. The average temperature was 160° C. at about $50\times10^5$ Pa, the liquid hourly space velocity was 3 $h^{-1}$ and the hydrogen/hydrocarbon ratio was 800 $Nm^3/m^3$.

The properties of the feedstock, of the effluent after hydrotreatment and of the jet engine fuel obtained after dearomatization are collected in the following Table 3.

TABLE 3

| | Feedstock | Effluent from Hydrotreatment | Jet Engine Fuel |
|---|---|---|---|
| Sp. gravity at 15° C. | 0.827 | 0.819 | 0.805 |
| Sulfur, ppm | 3600 | 4.5 | ≦10 |
| Nitrogen, ppm | 91 | 0 | 0 |
| Aromatic compounds, vol. % | 49 | 44 | 21.3 |
| Olefins, vol. % | 30.7 | 0.5 | 0 |
| Naphthenes/paraffins | — | 0.60 | 1.28 |
| cis-Decalin/trans-decalin | — | — | 0.55 |
| Naphthalene/trans-decalin | — | — | 0 |

The distillation curve is shown in the single drawing attached herewith.

Example 4

A feedstock distilling from 140 to 250° C. obtained by atmospheric distillation of a crude petroleum was treated in a "KEROX" mercaptan sweetening unit the operating principle of which is described concisely on page 877 of the book "Raffinage et genie chimique" [Refining and Chemical Engineering] by P. Wuithier, IFP [French Petroleum Institute], vol.1, 1972 edition.

A procedure known in itself was used in the presence of a cobalt phthalocyanine-based catalyst at a pressure of $8\times10^5$ Pa and a temperature of 50° C.

The properties of the feedstock and resulting jet engine fuel are collected in the following Table 4.

TABLE 4

| | Feedstock | Jet Engine Fuel |
|---|---|---|
| Sp. gravity at 15° C. | 0.785 | 0.785 |
| Sulfur, ppm | 450 | 404 |
| Nitrogen, ppm | ≦5 | ≦5 |
| Aromatic compounds, vol. % | 17.5 | 17.5 |
| Olefins, vol. % | 0 | 0 |
| Naphthenes/paraffins | 0.55 | 0.55 |
| cis-Decalin/trans-decalin | — | 0.04 |
| Naphthalene/trans-decalin | — | 8.06 |

The distillation curve is shown in the single drawing attached herewith.

Example 5

A feedstock distilling from 350 to 560° C. obtained by vacuum distillation was treated in a dual-reactor hydrocracking unit developed by UNOCAL and UOP. For reference, this hydrocracking system is described concisely on page 761 of the book "Raffinage et genie chimique" by P. Wuithier, IFP, vol. 1, 1972 edition.

The vacuum distillate feedstock was pretreated in a first reactor in the presence of a nitrogen-removing catalyst. The resulting effluent was then treated in the cracking reactor. Operating conditions were approximately the same as those indicated on page 764 of the book "Raffinage et genie chimique" by P. Wuithier, IFP, vol. 1, 1972 edition.

The properties of the feedstock and of the jet engine fuel obtained by fractionation are presented in the following Table 5.

TABLE 5

| | Feedstock | Jet Engine Fuel |
|---|---|---|
| Sp. gravity at 15° C. | 0.928 | 0.806 |
| Sulfur, ppm | 12,100 | 10 |
| Nitrogen, ppm | 866 | 0 |
| Aromatic compounds, vol. % | 52.5 | 9 |
| Olefins, vol. % | 0 | 0 |
| Naphthenes/paraffins | — | 1.14 |
| cis-Decalin/trans-decalin | — | 0.14 |
| Naphthalene/trans-decalin | — | 0.11 |

The distillation curve is shown in the drawing attached herewith.

The overall characteristics of JET A1 and of the jet engine fuels of Examples 1, 2, 3, 4, and 5 are described in the following Table 6.

The freezing points of the materials obtained in Examples 1 and 3, in particular, are much below the minimum required, namely below −47° C., and, hence, make possible the potential use of these jet engine fuels under conditions of extreme cold. Moreover, it can be seen that the lower heating value per unit volume of the jet engine fuels obtained according to the invention is particularly elevated compared to those of prior-art fuels.

TABLE 6

Properties of JET A1 Jet Engine Fuel and of the Fuels from the Examples

| Method | Property | Jet A1: Limits | Example 1 | Example 2 | Example 3 | Example 4 | Example 5 |
|---|---|---|---|---|---|---|---|
| Visual | Appearance | Clear & limpid (free of water and sediments at ambient T°) | Clear | Clear | Clear | Clear | Clear |
| ASTM | COMPOSITION | | | | | | |
| D1319 | Aromatics vol. % | 22.0 max. | 7.2 | 21 | 21.3 | 17.5 | 9.0 |
| | Olefins vol. % | 5.0 max. | 0.5 | 0 | 0 | 0 | 0 |
| | Saturated compounds vol. % | | 92.3 | 79 | 78.7 | 82.5 | 91.0 |
| D2789 | Paraffins vol. % | | 36.6 | 45.9 | 33.3 | 53.0 | 42.6 |
| | Naphthenes vol. % | | 56.5 | 31.1 | 42.7 | 29.5 | 48.4 |
| | Naphthenes/paraffins vol. % | | 1.54 | 0.68 | 1.28 | 0.55 | 1.14 |
| D2166 | Total sulphur ppm | 3000 max. | 0.1 | 0.1 | 0 | 404 | 0.3 |
| | VOLATILITY | | | | | | |
| D86 | Initial point ° C. | Plot | 145.0 | 163.1 | 145 | 147.7 | 149.1 |
| D86 | 10 vol. % coll. ° C. | 205 max. | 164.4 | 184.5 | 156.4 | 170.4 | 171.4 |
| D86 | 20 vol. % coll. ° C. | Plot | 171.0 | 191.3 | 162.0 | 177 | 180.5 |
| D86 | 50 vol. % coll. ° C. | Plot | 187.6 | 204.8 | 175.9 | 189.6 | 206.9 |
| D86 | 90 vol. % coll. ° C. | Plot | 222.1 | 229.3 | 199.9 | 215.7 | 257.6 |
| D86 | Final point ° C. | 300 max. | 250.6 | 246.2 | 222.5 | 235.5 | 277.3 |
| D86 | Residue vol. % | 1.5 max. | 1.5 | 1.4 | 1.2 | 1.2 | 1.4 |
| D86 | Loss vol. % | 1.5 max. | 0.8 | 1.5 | 1.5 | 0.4 | 0.7 |
| D3828 | Flash point ° C. | 38 min. | 39 | 50 | 38 | | |
| D1298 | Sp. gravity at 15° C. kg/m$^3$ | 775–840 | 803.5 | 813.2 | 804.8 | 785 | 805.7 |

TABLE 6-continued

Properties of JET A1 Jet Engine Fuel and of the Fuels from the Examples

| Method | Property | Jet A1: Limits | Example 1 | Example 2 | Example 3 | Example 4 | Example 5 |
|---|---|---|---|---|---|---|---|
| | FLUIDITY | | | | | | |
| D2386 | Point of crystal disappearance ° C. | minus 47 max. | <−75 | <53.5 | <−75 | −50 | −51.5 |
| | COMBUSTION | | | | | | |
| D3338 | Lower heating value | | | | | | |
| | MJ/kg | 42.8 | 43.256 | 43.09 | 43.07 | 43.40 | 43.39 |
| | MJ/l | | 34.758 | 35.04 | 34.67 | 34.60 | 34.58 |
| D1322 | Smoke point mm | 25 min. | 27 | | | 25 | 26 |
| | or smoke point mm | 19 min. | | 21 | 21 | | |
| | and naphthalenes vol. % | 3.0 max. | | 0 | 0 | | |
| | CORROSION | | | | | | |
| D130 | Copper corrosion: Classification | 1 max. | 1 | 1 | 1 | 1 | 1 |
| | Silver corrosion: Classification | 2 max. | 0 | 0 | 0 | 0 | 0 |
| | HEAT STABILITY (260 ° C.) | | | | | | |
| D3241 | Delta P of filter mm Hg | 25.0 max. | <1 | <1 | <1 | <1 | <1 |
| | Tube rating (Visual) | <3 max. | 0 | 0 | 0 | 0 | 0 |

We claim:

1. Jet engine fuel comprising following characteristics:

i) a distilling range from 140 to 300° C.;

ii) a cis-decalin/trans-decalin ratio greater than 0.2;

iii) an aromatics content less than 22% by volume;

iv) a sulfur content less than 100 ppm;

v) a lower heating value per unit volume greater than 34.65 Mj/liter; and vi) a naphthenes/paraffins ratio between 1.2 and 2.

2. Jet engine fuel according to claim 1, wherein its lower heating value per unit volume is between 34.65 and 35.30 Mj/liter.

3. Jet engine fuel according claim 1, wherein its cis-decalin/trans-decalin ratio is greater than 0.3.

4. Jet engine fuel claim 1, wherein its naphthalene/trans-decalin ratio is less than 0.05.

5. A process for making a jet engine fuel comprising the following characteristics:

i) a distilling range from 140 to 300° C.;

ii) a cis-decalin/trans-decalin ratio greater than 0.2;

iii) an aromatics content less than 22% by volume;

iv) a sulfur content less than 100 ppm;

v) a lower heating value per unit volume greater than 34.65 Mj/liter; and vi) a naphthenes/paraffins ratio is between 1.2 and 2; said process comprising subjecting a cut from catalytic cracking distilling between 140 and 300° C. to a hydrotreatment step and then to a dearomatization step.

6. The process according to claim 5, wherein the hydrotreatment step is carried out on at least one fixed bed of a catalyst containing at least one hydrogenating and/or hydrogenolyzing noble metal at an average temperature from 250 to 350° C., a minimum pressure of $30\times10^5$ Pa, a liquid hourly space velocity of 1 to 5 $h^{-1}$ and a hydrogen/hydrocarbon ratio from 100 to 500 $Nm^3/m^3$.

7. The process according to claim 6, wherein the catalyst contains cobalt and molybdenum or nickel and molybdenum.

8. The process according to claim 5, wherein the dearomatization step is carried out in the presence of a catalyst containing at least one noble metal selected from among platinum and/or palladium, disposed on at least one fixed bed, at a temperature from 200 to 300° C., a minimum pressure of $30\times10^5$ Pa, a liquid hourly space velocity of 1 to 5 $h^{-1}$ and a hydrogen/hydrocarbon ratio from 500 to 900 $Nm^3/m^3$.

9. The process according to claim 6, wherein the dearomatization step is carried out in the presence of a catalyst based on nickel disposed in the form of at least one fixed bed, at a temperature from 100 to 200° C., a minimum pressure of $30\times10^5$ Pa, a liquid hourly space velocity of 1 to 5 $h^{-1}$ and a hydrogen/hydrocarbon ratio from 600 to 1000 $Nm^3/m^3$.

10. The process according to claim 5, wherein a diluent is used in at least one step of said process to control the exothermicity of the reaction.

11. The process according to claim 10, wherein, before hydrotreatment, a diluent is blended with the cut from catalytic cracking, said diluent being a kerosene fraction obtained by atmospheric distillation of crude petroleum.

12. The process according to claim 7, wherein the dearomatization step is carried out in the presence of a catalyst containing at least one noble metal selected from among platinum and/or palladium disposed on at least one fixed bed, at a temperature from 200 to 300° C., a minimum pressure of $30\times10^5$ Pa, a liquid hourly space velocity of 1 to 5 $h^{-1}$ and a hydrogen/hydrocarbon ratio from 500 to 900 $Nm^3/m^3$.

13. The process according to claim 7, wherein the dearomatization step is carried out in the presence of a catalyst based on nickel disposed in the form of at least one fixed bed, at a temperature from 100 to 200° C., a minimum pressure of $30\times10^5$ Pa, a liquid hourly space velocity of 1 to 5 $h^{-1}$ and a hydrogen/hydrocarbon ratio from 600 to 1000 $Nm^3/m^3$.

14. The process according to claim 10, wherein, before hydrotreatment, a diluent is blended with the cut from catalytic cracking, said diluent being a kerosene fraction obtained by atmospheric distillation of crude petroleum.

15. Jet engine fuel according to claim 2, wherein its naphthenes/paraffins ratio is between 1.2 and 2; wherein its cis-decalin/trans-decalin ratio is greater than 0.3; and wherein its naphthalene/trans-decalin ratio is less than 0.05.

16. The jet fuel of claim 1 which is prepared by a process comprising subjecting a cut from catalytic cracking distilling between 140 and 300° C. to a hydrotreatment step and then to a dearomatization step.

17. The jet-fuel of claim 16 wherein the cut has an olefin content of 20 to 45% and an aromatics content of 40 to 70% based on total volume.

18. The process of claim 5 wherein the cut has an olefin content of 20 to 45% and an aromatics content of 40 to 70% based on total volume.

* * * * *